US008172415B2

(12) United States Patent
Wegh et al.

(10) Patent No.: US 8,172,415 B2
(45) Date of Patent: May 8, 2012

(54) COLOR-TUNABLE ILLUMINATION SYSTEM

(75) Inventors: Rene Theodorus Wegh, Eindhoven (NL); Christoph Gerard August Hoelen, Eindhoven (NL); Chantal Sweegers, Eindhoven (NL); Rene Jan Hendriks, Eindhoven (NL); Martijn Henri Richard Lankhorst, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 354 days.

(21) Appl. No.: 12/600,511

(22) PCT Filed: May 20, 2008

(86) PCT No.: PCT/IB2008/051972

§ 371 (c)(1),
(2), (4) Date: Nov. 17, 2009

(87) PCT Pub. No.: WO2008/142638

PCT Pub. Date: Nov. 27, 2008

(65) Prior Publication Data

US 2010/0172120 A1 Jul. 8, 2010

(30) Foreign Application Priority Data

May 24, 2007 (EP) ..... 07108844

(51) Int. Cl.
*F21V 9/16* (2006.01)

(52) U.S. Cl. ..... 362/84; 362/231; 362/238; 362/239; 362/240; 362/241

(58) Field of Classification Search ..... 362/84, 362/231, 238–241, 248
See application file for complete search history.

(56) References Cited

U.S. PATENT DOCUMENTS 4,416,075 A 11/1983 Bauer
6,357,889 B1 3/2002 Duggal et al.
(Continued)

FOREIGN PATENT DOCUMENTS

DE 29804149 U1 6/1998
(Continued)

*Primary Examiner* — Stephen F Husar
*Assistant Examiner* — James Cranson, Jr.
(74) *Attorney, Agent, or Firm* — Mark L. Beloborodov

(57) ABSTRACT

The invention relates to a color-tunable illumination system (10; 12; 14) and a luminaire. The color-tunable illumination system comprises a first light source comprising a first set of light emitting diodes (21, 24), and a second light source comprising a second set of light emitting diodes (31, 37, 34). Both the first and second light source emit light of substantially a first predefined color into a light mixing chamber (60). The light mixing chamber further comprises a first luminescent material (50) converting light of the first predefined color into light of a second predefined color. The first light source is positioned with respect to the first luminescent material for illuminating the first luminescent material with a first flux of light being part of the light emitted by the first light source into the light mixing chamber. The second light source is positioned with respect to the first luminescent material for illuminating the first luminescent material with a second flux of light being part of the light emitted by the second light source into the light mixing chamber. The first flux is different from the second flux. The effect of the measures according to the invention is that a change in the intensity of the light emitted by the first light source relative to the intensity of the light emitted by the second light source results in a change of the color emitted by the color-tunable illumination system.

14 Claims, 3 Drawing Sheets

U.S. PATENT DOCUMENTS

| | | | | |
|---|---|---|---|---|
| 6,759,814 | B2 | 7/2004 | Vogel et al. | |
| 6,776,508 | B2 | 8/2004 | Bucher et al. | |
| 7,025,464 | B2 | 4/2006 | Beeson et al. | |
| 7,040,774 | B2 * | 5/2006 | Beeson et al. | 362/84 |
| 7,131,785 | B1 * | 11/2006 | Mansouri | 401/195 |
| 7,144,131 | B2 | 12/2006 | Rains | |
| 7,145,125 | B2 * | 12/2006 | May et al. | 250/228 |
| 7,213,940 | B1 | 5/2007 | Van De Ven et al. | |
| 7,374,311 | B2 * | 5/2008 | Rains et al. | 362/234 |
| 2004/0165379 | A1 | 8/2004 | Waters | |
| 2005/0041424 | A1 | 2/2005 | Ducharme | |
| 2005/0236958 | A1 | 10/2005 | Wang et al. | |
| 2006/0072314 | A1 | 4/2006 | Rains | |
| 2007/0090381 | A1 | 4/2007 | Otsuka et al. | |
| 2010/0254115 | A1 * | 10/2010 | Wegh et al. | 362/84 |
| 2010/0290208 | A1 * | 11/2010 | Pickard | 362/84 |

FOREIGN PATENT DOCUMENTS

| | | | |
|---|---|---|---|
| GB | 2288974 | A | 11/1995 |
| JP | 11025720 | | 1/1999 |
| JP | 11249607 | | 9/1999 |
| WO | 0129909 | A1 | 4/2001 |
| WO | 2005006815 | A2 | 1/2005 |
| WO | 2005055328 | A1 | 6/2005 |
| WO | 2005120135 | A1 | 12/2005 |
| WO | 2006133214 | A2 | 12/2006 |

* cited by examiner

COLOR-TUNABLE ILLUMINATION SYSTEM

FIELD OF THE INVENTION

The invention relates to a color-tunable illumination system comprising a first light source, a second light source and a layer of first luminescent material.

The invention also relates to a luminaire comprising the illumination system.

BACKGROUND OF THE INVENTION

Such illumination systems are known per se. They are used, inter alia, as luminaire for general lighting purposes, for example, for office lighting, for shop lighting or, for example, for in-home general lighting purposes.

The luminescent material generally absorbs part of the light emitted by a light source of the color-tunable illumination system and converts the absorbed light into light of a different color. The luminescent material is often arranged at a distance from the light source. This configuration is also referred to as a remote phosphor configuration. A benefit when using the remote phosphor configuration is that the conversion efficiency and the life-time of the luminescent material are improved and that the range of luminescent materials to choose from is improved.

Such a color-tunable illumination system is known from US 2005/0041424. In an embodiment of the known color-tunable illumination system the illumination system comprises at least a first blue light emitting diode emitting light having the color blue, and at least a second blue light emitting diode emitting light having the same color blue. The known illumination system comprises luminescent material which is arranged in so called carrier material. The carrier material is arranged in strips covering portions of a housing which surrounds the first and second light emitting diodes. The strips of carrier material may be arranged such that the illumination from at least one of the light emitting diodes is projected through the carrier material. By modulating the power of the separate light emitting diodes, the illumination conditions can be adapted, thus tuning a color of the known illumination system.

A disadvantage of the known illumination system is that light emitted from the known illumination system creates colored shadows.

SUMMARY OF THE INVENTION

It is an object of the invention to provide a color-tunable illumination system which reduces the occurrence of colored shadows.

According to a first aspect of the invention the object is achieved with a color-tunable illumination system according to claim 1. According to a second aspect of the invention, the object is achieved with a luminaire as claimed in claim 13. The color-tunable illumination system according to the invention comprises a first light source, a second light source and a layer of first luminescent material being arranged inside a light mixing chamber, the light mixing chamber having a light exit window for emitting the light from the light mixing chamber, the first light source and the second light source each comprising at least one light emitting diode and emitting light of a first predefined color into the light mixing chamber, the first luminescent material absorbing light of the first predefined color and converting the absorbed light into light of a second predefined color different from the first predefined color, the first luminescent material being arranged remote from the first light source and the second light source, the first light source being positioned with respect to the first luminescent material for illuminating the first luminescent material with a first relative flux of light being a part of the light emitted by the first light source into the light mixing chamber, the second light source being positioned with respect to the first luminescent material for illuminating the first luminescent material with a second relative flux of light being part of the light emitted by the second light source into the light mixing chamber (60), the first relative flux being different from the second relative flux, and the color-tunable illumination system further comprising a controller for controlling an intensity of the light emitted by the first light source relative to the intensity of the light emitted by the second light source and/or for controlling a position of the first light source with respect to the luminescent material relative to the position of the second light source with respect to the luminescent material.

The effect of the color-tunable light source according to the invention is that the use of the light mixing chamber generates substantially homogeneously mixed light emitted from the illumination system which prevents the occurrence of colored shadows. By using the controller, the intensity of the light emitted by the first light source can be tuned relative to the second light source which alters a flux of light of the first predefined color through the first luminescent material. Because the first relative flux is different from the second relative flux, the contribution of the light of the second predefined color to the mixed light emitted from the light mixing chamber can be controlled, thus tuning the light emitted by the color-tunable illumination system according to the invention. Consequently the color of the light emitted by the color-tunable illumination system may be altered while preventing colored shadows to occur.

In the known color-tunable illumination system, the different colors are produced by different light sources which are arranged in an array. When using these known color-tunable illumination systems in general lighting applications, the shadow of an object illuminated by the color-tunable illumination system will be constituted of a multiple of shadows originating from the different colored light sources and thus will have different colors resulting in colored shadows. In the color-tunable illumination system according to the invention the light from the different light sources and from the first luminescent material is mixed inside the light mixing chamber such that the light emitted by the color-tunable illumination system is substantially homogeneously mixed. When illuminating the object with light originating from the color-tunable illumination system according to the invention, the colored shadows will be reduced.

The inventors have realized that the position of the first luminescent material with respect to the first and second light source may be used to define a relative flux of the light of the first predefined color through the first luminescent material which may be used to alter a contribution of the converted light by the first luminescent material to the light emitted by the illumination system. To alter the color of the light emitted by the illumination system the controller, for example, alters the intensity of the light emitted by the first light source relative to the second light source. Alternatively, the controller alters a position of the first light source and/or of the second light source with respect to the luminescent material. The changing of the position alters the difference between the first relative flux with respect to the second relative flux and thus tunes the color of the emitted light by tuning the contribution of the light of the second predefined color to the mixed light emitted from the light mixing chamber. the intensity of the light emitted by the first light source relative to the second light source.

In this context, light of a predefined color typically comprises light having a predefined spectrum. The predefined spectrum may, for example, comprise a primary color having a specific bandwidth around a predefined wavelength, or may, for example, comprise a plurality of primary colors. The predefined wavelength is a mean wavelength of a radiant power spectral distribution. In this context, light of a predefined color also includes non-visible light, such as ultraviolet light. The light of a primary color, for example, includes Red, Green, Blue, Yellow and Amber light. Light of the predefined color may also comprise mixtures of primary colors, such as Blue and Amber, or Blue, Yellow and Red. By choosing, for example, a specific combination of the Red, Green and Blue light substantially every color can be generated by the illumination system, including white. Also other combinations of primary colors may be used in the light projection system which enables the generation of substantially every color, for example, Red, Green, Blue, Cyan and Yellow. The number of primary colors used in the color-tunable illumination system may vary.

In an embodiment of the color-tunable illumination system, the first light source is arranged for directly illuminating the first luminescent material, and the second light source is shielded from directly illuminating the first luminescent material By shielding the light emitted by the second light source from directly illuminating the first luminescent material the efficiency of the tuning of the light emitted by the color-tunable illumination system can be improved. Using the light mixing chamber generally homogeneously mixes the light from all light sources to generate a substantially homogeneously mixed light beam emitted from the light exit window of the light mixing chamber. Shielding to prevent direct illumination of the first luminescent material by the second light source can be achieved by proper placement of the first luminescent material and the first and second light source. Indirect illumination however will generally always be present to some extent, since light from the first luminescent material has to enter the mixing chamber, so light can travel in the opposite direction as well.

In an embodiment of the color-tunable illumination system, dichroic shielding means are arranged for shielding the second light source from illuminating the first luminescent material. The dichroic shielding means may, for example, transmit light of the second predefined color, and may reflecting light from the first predefined color.

In an embodiment of the color-tunable illumination system, the light mixing chamber comprises a further luminescent material converting light of the first predefined color into a further predefined color different from the first predefined color and the second predefined color. The further predefined color preferably is visible light, for example, white light. The light of the first predefined color, for example, may have a central wavelength in a range between 200 and 400 nanometers. Light in a range between 200 and 400 nanometers is also known as ultraviolet light. A benefit when using ultraviolet light as light of the first predefined color is that the color point of the light leaving the mixing chamber is only determined by a mixture of phosphors in the luminescent material because the light of the first predefined color does not contribute to the visible light. This as opposed to using blue light as light of the first predefined color, where the color point of the light leaving the light mixing chamber is also determined by thickness of the applied luminescent material since the thickness of the luminescent material determines an extent of the conversion of the blue light into light of the second predefined color. This means that the phosphor thickness when using blue light needs to be properly controlled, whereas this is not necessary for using light.

In an embodiment of the color-tunable illumination system, the first predefined color is within a ranged between 400 nanometers and 490 nanometers. Light having a central wavelength in a range between 400 and 490 nanometers is also known as blue light. A benefit when using blue light as light of the first predefined color is that this light is visible to humans and thus can directly be mixed into the output of the color-tunable illumination system without conversion. Any conversion using luminescent materials to convert light from one color to another introduces some loss of energy due to a Stokes-shift involved in the conversion. Using blue light as light of the first predetermined color some of the light emitted by the color-tunable illumination system does not need to be converted which increases the efficiency of the system. Furthermore, the Stokes-shift when converting blue light into light of the second predefined color is less than when converting ultraviolet light into light of the second predefined color, further increasing the efficiency. Furthermore, the color blue is one of the primary colors which may be used to mix with other primary colors such as red and green or such as yellow to obtain white light. For example, when choosing the further luminescent material to absorb part of the blue light emitted by the first and second light source and emits the further predefined color being the color yellow, and the amount of luminescent material is chosen properly so as to obtain the proper extent of conversion of light of the first predefined color, the light emitted from the color-tunable illumination system basically is the color white (due to the combination of remainder of the blue light and yellow light emitted by the further luminescent material). Adding the light of the second predefined color to the substantially white light will enable the color temperature of the light emitted by the color-tunable illumination system to be altered. Omitting the use of ultraviolet light in the color-tunable illumination system by using blue light as light of the first predefined color provides a further benefit that an additional UV-filter may be omitted. The UV-filter is typically required to prevent ultraviolet light from being emitted by the color-tunable illumination system. When the color-tunable illumination system is used in, for example, general lighting applications, the emission of ultraviolet light must be avoided because it is harmful to the human eye. When the light of the first predefined color is ultraviolet light, the light exit window typically contains the UV-filter which absorbs or reflects ultraviolet light before it is emitted. When using light emitting diodes which emit light of the color blue the UV-filter may be omitted which again increases the efficiency of the system and which reduces the cost of the color-tunable illumination system.

In an embodiment of the color-tunable illumination system, the color-tunable illumination system further comprises a third light source and a third luminescent material, the third light source comprising at least one light emitting diode emitting light of the first predefined color into the light mixing chamber, the third light source being arranged for directly illuminating the third luminescent material while the first light source and second light source being shielded from directly illuminating the third luminescent material, the third luminescent material absorbing light of the first predefined color and converting the absorbed light into light of a third predefined color different from the first predefined color and second predefined color. A benefit of this embodiment is that the use of the third luminescent material increases a range within which the color of the light emitted by the color-tunable illumination system can be tuned. For example, the adding of the light of the second predefined color may shift the color of the light emitted by the color-tunable illumination system from blue to yellow (or part thereof), while the adding of the light of the third predefined color may shift the color of the light emitted by the color-tunable illumination system from green to red (or part thereof). In another embodiment, the third light source and third luminescent material may be used to "fine-tune" the changing of the color temperature to properly follow, for example, the black body locus, which is a curved line in the color space. To follow a curved line in color space, three light sources with controlled relative intensities are needed.

In an embodiment of the color-tunable illumination system, the first luminescent material and/or the further luminescent material and/or the third luminescent material comprises a phosphor composition being a mixture of phosphors, each phosphor composition of the first luminescent material, the further luminescent material and/or the third luminescent material being different. For example, in the embodiment in which the first predefined color is ultraviolet light, the further luminescent material may, for example, be a mixture of phosphors providing substantially white light having a predefined color temperature and the first luminescent material and third luminescent material may convert the absorbed ultraviolet light into light of the second predefined color and of the third predefined color, respectively, which changes the color of the light emitted by the color-tunable illumination system, for example, to higher, respectively lower color temperature.

In an embodiment of the color-tunable illumination system, the first light source and/or the second light source comprises a series arrangement of a plurality of light emitting diodes. A benefit of this embodiment is that the use of a light source comprising a plurality of light emitting diodes enables an increase in the intensity of the light emitted by the color-tunable illumination system. Furthermore, the use of a plurality of light emitting diodes enables a more uniform distribution of the light emitting diodes inside the light mixing chamber which further improves a mixing of the light of the different light emitting diodes, resulting in an improved mixture of the light emitted by the color-tunable illumination system.

In an embodiment of the color-tunable illumination system, the light emitting diodes of the first light source are arranged in a further light mixing chamber comprising the first luminescent material or in a plurality of further light mixing chambers comprising the first luminescent material, the further light mixing chamber or the plurality of further light mixing chambers being arranged inside the light mixing chamber. A benefit of this embodiment is that the use of the further light mixing chamber or the plurality of further light mixing chambers pre-mixes the light of the first light source with the light of the second predefined color which improves the overall color mixing inside the light mixing chamber. The wall of the first light mixing chamber may, for example, be constituted of dichroic shielding means allowing light of the second predefined color to pass and reflecting light of the first predefined color. This arrangement substantially shields light of the second light source from impinging on the first luminescent material which enhances the color-tunability efficiency of the color-tunable illumination system according to the invention.

In an embodiment of the color-tunable illumination system, when the color-tunable illumination system comprises the further luminescent material, the plurality of light emitting diodes are arranged to substantially uniformly illuminate the light exit window of the light mixing chamber and wherein the further luminescent material is arranged at the light exit window of the light mixing chamber. A benefit of this embodiment is that it enables the color-tunable illumination system to be relatively compact. The light of the further predetermined color emitted by the further luminescent material is emitted substantially in all directions, and thus also emitted back into the light mixing chamber. Due to this emission of the light from the further luminescent material, part of the light of the further predetermined color is mixed in the light mixing chamber, further improving the color mixing of the color-tunable illumination system. Light generated by the first luminescent material must be transmitted through the light exit window and thus through the further luminescent material. Preferably the further luminescent material does not absorb light of the second predefined color or only absorbs a very small part of the light of the second predefined color.

In an embodiment of the color-tunable illumination system, the first and the second light source are arranged on an edge of the light mixing chamber next to the light exit window, each of the first and the second light source emitting light away from the light exit window preventing direct illumination of the light exit window by the first and the second light sources A benefit of this embodiment is that the light emitting diodes of the first and second light sources do not directly illuminate the light exit window which ensures good mixing of light and reduces a glare of the light source. An additional benefit is that the first and the second light source may be cooled without the use of active cooling arrangements such as fans or Peltier elements. The first and the second light source comprise a light emitting diode. Typically, light emitting diodes require some kind of cooling. When the first and the second light source is arranged on the edge of the light mixing chamber of the color-tunable illumination system next to the light exit window, the cooling of the light emitting diodes may be provided via cooling fins arranged, for example, on the outside of a housing of the color-tunable illumination system. This enables the color-tunable illumination system to be built into a luminaire or, for example, into a ceiling of a house, office or shop, while cooling the light emitting diodes via the cooling fins protruding from the luminaire or ceiling.

In an embodiment of the color-tunable illumination system, the first predefined color is the color blue, the first luminescent material converts the absorbed light of the first predefined color into amber light being the second predefined color, and the further luminescent material converts the absorbed light of the first predefined color into yellow light being the further predefined color. A benefit of this embodiment is that using a first luminescent material emitting amber, a further luminescent material emitting yellow together with the first predefined color being blue, the color-tunable illumination system according to the invention can tune the color of the emitted light from relatively cold white to warm white, for example, between 6500K and 2700K substantially along the black-body locus. For example, the first luminescent material comprises a mixture of $Y_3Al_5O_{12}:Ce^{3+}$ and $CaS:Eu^{2+}$, and the further luminescent material (52) comprises $Y_3Al_5O_{12}:Ce^{3+}$. Alternatively, the first luminescent material comprises $(Ba, Sr)_2Si_5N_8:Eu^{2+}$, and the further luminescent material comprises $Y_3Al_5O_{12}:Ce^{3+}$. In a third embodiment, the first luminescent material comprises a mixture of $Lu_3Al_5O_{12}:Ce^{3+}$ and $CaS:Eu^{2+}$, and the further luminescent material comprises a mixture of $Lu_3Al_5O_{12}:Ce^{3+}$ and $CaS:Eu^{2+}$ with a different phosphor ratio. The first luminescent material may, for example, comprise a mixture of 85% w/w $Y_3Al_5O_{12}:Ce^{3+}$ (further also referred to as YAG:Ce) and 15% w/w $CaS:Eu^{2+}$, (further also referred to as CaS:Eu) which mixture emits the second predefined color amber. The luminescent material $(Ba,Sr)_2Si_5N_8:Eu^{2+}$ (further also referred to as BSSN:Eu) emits the second predefined color amber. The luminescent material $Lu_3Al_5O_{12}:Ce^{3+}$ (further also referred to as LuAG:Ce) emits the second predefined color green, and the luminescent material $CaS:Eu^{2+}$ (further also referred to as CaS:Eu) emits the second predefined color red. The embodiments using BSSN:Eu and YAG:Ce with blue light, and using two mixtures of LuAG:Ce and CaS:Eu with blue light can realize substantially the same effect. Other phosphors that convert blue light into red light, such as $(Ba,Sr,Ca)_2Si_5N_8:Eu^{2+}$, $(Sr,Ca)S:Eu^{2+}$, and $(Ca,Sr)AlSiN_3:Eu^{2+}$, can be used instead of CaS:Eu, reaching substantially the same effect. Other phosphors that convert blue light into green light, such as $Sr_2Si_2N_2O_2:Eu^{2+}$, and $SrGa_2S_4:Eu^{2+}$, can be used instead of LuAG:Ce, reaching substantially the same effect. The garnet luminescent materials YAG:Ce and LuAG:Ce can be replaced by $(Y_{3-x-y}Lu_xGd_y)(Al_{5-z}Si_z)(O_{12-z}N_z):Ce$ having $0<x\leqq3$, $0\leqq y\leqq2.7$, $0<x+y\leqq3$ and $0<z\leqq2$.

Using light sources emitting ultraviolet light and a first and a further luminescent material comprising for example a mixture of $BaMgAl_{10}O_{17}:Eu^{2+}$ (converting ultraviolet light into blue light), $Ca_8Mg(SiO_4)_4Cl_2:Eu^{2+}, Mn^{2+}$ (converting ultraviolet light into green light), and $Y_2O_3:Eu^{3+}, Bi^{3+}$ (converting ultraviolet light into red light) with different phosphor ratios can enable a shift from relatively cold white to warm white, for example between 6500K and 2700K substantially along the black body locus. Any other color change is possible as well, determined by the phosphor ratio. Any other phosphor converting ultraviolet light into blue, green or red light or any other color can be used instead of the phosphors mentioned above.

BRIEF DESCRIPTION OF THE DRAWINGS

These and other aspects of the invention are apparent from and will be elucidated with reference to the embodiments described hereinafter.

In the drawings.

The figures are purely diagrammatic and not drawn to scale. Particularly for clarity, some dimensions are exaggerated strongly. Similar components in the figures are denoted by the same reference numerals as much as possible.

DETAILED DESCRIPTION OF EMBODIMENTS

Figure 1A:
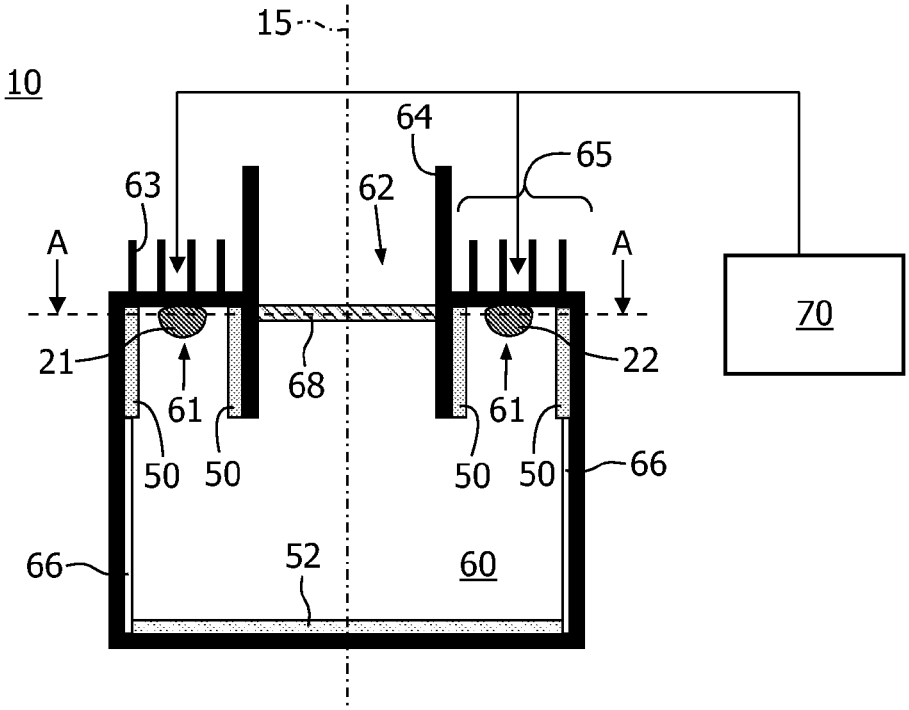
FIGS. 1A, 1B and 1C show schematic cross-sectional views of a color-tunable illumination system according to the invention.
Figure 1B:
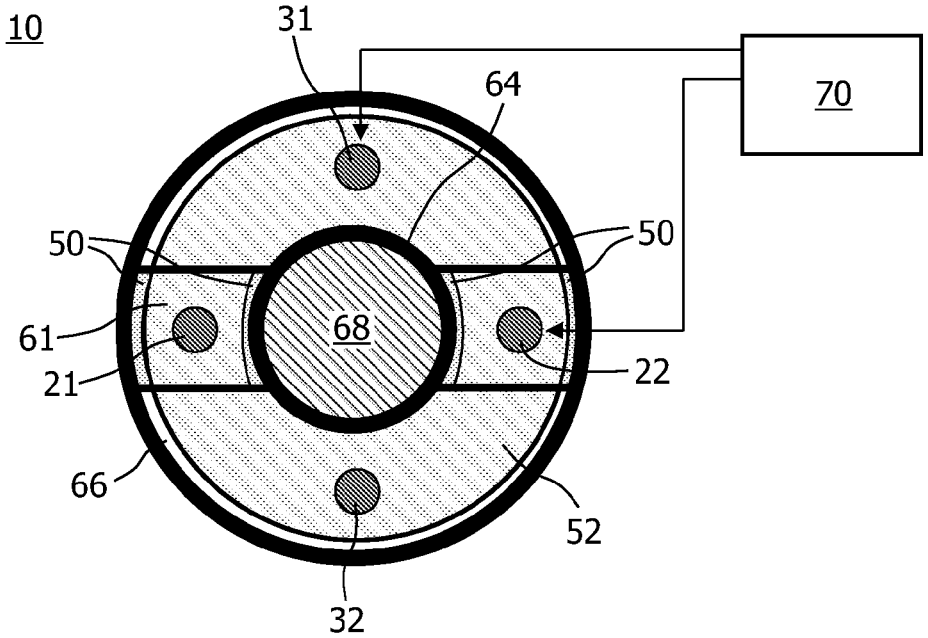
Figure 1C:
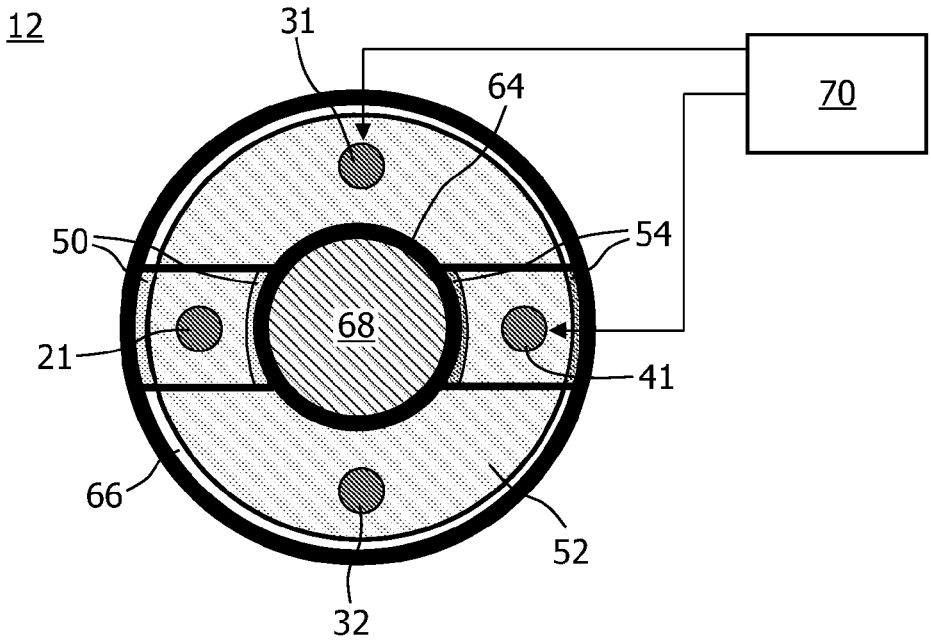

FIGS. 1A, 1B and 1C show schematic cross-sectional views of a color-tunable illumination system 10, 12 according to the invention. The color-tunable illumination system 10, 12 comprises a first light source 21, 22 constituted of a first set of light emitting diodes 21, 22. The first set of light emitting diodes 21, 22 emit light of a first predefined color into a light mixing chamber 60. The light mixing chamber 60 further comprises a layer of luminescent layer 50 which is arranged remote from the first light source 21, 22 and which absorbs part of the light of the first predefined color and converts the absorbed light into light of a second predefined color, different from the first predefined color. The color-tunable illumination system 10, 12 further comprises a second light source 31, 32 constituted of a second set of light emitting diodes 31, 32 which emit light of substantially the same first predefined color into the light mixing chamber 60. The first set of light emitting diodes 21, 22 is, for example, arranged for directly illuminating the first luminescent material 50. The second set of light emitting diodes 31, 32 is, for example, shielded from directly illuminating the first luminescent material 50. The light from the first light source 21, 22, from the second light source 31, 32 and from the first luminescent material 50 is mixed inside the light mixing chamber 60 generating substantially homogeneously mixed light which is emitted by the color-tunable illumination system 10, 12 according to the invention. The color-tunable illumination system 10, 12 according to the invention further comprises a controller 70 for controlling a flux of the light emitted by the first set of light emitting diodes 21, 22 relative to the flux of the light of the second set of light emitting diodes 31, 32.

In the embodiment of the color-tunable illumination system 10, 12 as shown in FIGS. 1A, 1B and 1C, the color-tunable illumination system 10, 12 further comprises a further luminescent material 52 which converts light of the first predefined color into a further predefined color different from the first predefined color and the second predefined color. The walls of the light mixing chamber 60 are covered with a diffusely reflective layer 66 for mixing the light which is generated inside the light mixing chamber 60. The mixed light is emitted from the color-tunable illumination system 10, 12 via a light exit window 62 which comprises a collimator 64. The light exit window 62 further comprises a diffuser 68 for further enhancing the mixture of the light emitted from the color-tunable illumination system 10, 12. In the embodiment of the color-tunable illumination system 10, 12 shown in FIGS. 1A, 1B and 1C the light emitting diodes 21, 22, 31, 32, 41 are arranged on an edge 65 of the light mixing chamber 60 emitting light in a direction generally away from the light exit window 62. This arrangement of the light emitting diodes 21, 22, 31, 32, 41 ensures that the light emitting diodes 21, 22, 31, 32, 41 do not directly illuminate the light exit window 62 which reduces a glare of the color-tunable illumination system 10, 12. Finally, in the embodiment of the color-tunable illumination system 10, 12 according to the invention, the light mixing chamber 60 comprises cooling fins 63 for cooling the light emitting diodes 21, 22, 31, 32, 41 arranged on the edge 65. Due to the arrangement of the light emitting diodes 21, 22, 31, 32, 41 at the edge 65 of the light mixing chamber 60, the light emitting diodes 21, 22, 31, 32, 41 can be cooled using these cooling fins 63, even while being built, for example, in a ceiling of a home, office or shop.

In an embodiment of the color-tunable illumination system 10, 12, the first predefined color has a predefined wavelength in a range between 400 and 490 nanometers. This light of the first predefined color is also known as light of a primary color blue which is visible light to a human. Using, for example, YAG:Ce as further luminescent material 52 emits light of a primary color yellow when illuminated by light of the primary color blue. Combining the primary color blue and the primary color yellow inside the light mixing chamber 60 results in substantially cool white light which is emitted from the color-tunable illumination system 10, 12. The amount of the further luminescent material 52 inside the light mixing chamber 60 determines the color temperature of the white light emitted from the light mixing chamber 60. The first luminescent material 50 may, for example, comprise a mixture of the phosphors YAG:Ce and CaS:Eu, wherein the YAG:Ce contributes to the primary color yellow and wherein the CaS:Eu emits light of the primary color red which are mixed inside the light mixing chamber 60. By varying, for example, the weight percentages of the mixture of phosphors constituting the first luminescent material 50, the rate of change of the color of the light emitted by the light mixing chamber 60 of the color-tunable illumination system 10, 12 can be manipulated. Thus a specific range within which the color-tunable illumination system 10, 12 can be tuned can be preset. The combination of YAG:Ce and CaS:Eu enables the range of the change of color of the color-tunable illumination system 10, 12 to be near the black-body locus defined in the color-space. This embodiment is especially beneficial when using these color-tunable illumination systems 10, 12 in luminaires used in general illumination applications, because these color variations may, for example, be ultraviolet light which illuminates the further luminescent material 52 to most closely resemble variations in white light, as in sunlight throughout a day from morning to evening.

The light of the first predefined color produce, for example, substantially white light. Using light sources emitting ultraviolet light and a first and a further luminescent material comprising for example a mixture of $BaMgAl_{10}O_{17}:Eu^{2+}$ (converting ultraviolet light into blue light), $Ca_8Mg(SiO_4)_4Cl_2:Eu^{2+},Mn^{2+}$ (converting ultraviolet light into green light), and $Y_2O_3:Eu^{3+},Bi^{3+}$ (converting ultraviolet light into red light) with different phosphor ratios can enable a shift from relatively cold white to warm white, for example between 6500K and 2700K.

Alternatively, other phosphors and/or phosphor mixtures may be used to obtain a change of color of the color-tunable illumination system according to the invention.

In a preferred embodiment of the color-tunable illumination system 10, 12 according to the invention, the light source 21, 22, 31, 32, 41 comprises light emitting diodes 21, 22, 31, 32, 41. However, the light source 21, 22, 31, 32, 41 may be any suitable light source, such as an organic LED, a low-pressure discharge lamp, a high-pressure discharge lamp, an incandescent lamp or a laser light source.

FIG. 1A shows a cross-sectional view of the color-tunable illumination system 10 along a longitudinal axis 15 (indicated with a dash-dotted line 15). The light emitting diodes 21, 22 of the first light source 21, 22 together with the first luminescent material 50 are arranged in a separate section of the light mixing chamber 60 which constitutes a further light mixing chamber 61 arranged inside the light mixing chamber 60. This separate arrangement of the first luminescent material 50 results in a shielding of the first luminescent material 50 from direct illumination by the second light source 31, 32 and to premix the light of the first light source 21, 22 with the converted light from the first luminescent material 50.

FIG. 1B shows a cross-sectional view of the color-tunable illumination system 10 along a cross-section AA indicated in FIG. 1A with a dashed line. In this cross-sectional view of the color-tunable illumination system 10, the walls of the light mixing chamber are covered with the diffusely reflective layer 66. In addition, the further light mixing chambers 61 are shown comprising the first luminescent material 50 and comprising the light emitting diodes 21, 22 of the first set of light emitting diodes 21, 22 constituting the first light source 21, 22. The walls of the further light mixing chamber 61 may, for example, be constituted of dichroic shielding means allowing light of the second predefined color to pass and, for example, reflecting light of the first predefined color. Typically, the light emitting diodes 21, 22 of the first set of light emitting diodes 21, 22 and the light emitting diodes 31, 32 of the second set of light emitting diodes 31, 32 are each arranged in a series arrangement such that, in use, substantially the same current flows through the first set and the second set. A benefit of this series arrangement is that the intensity of both light the first set and the second set can be varied with respect to each other by only varying the current through the series arrangement of the diodes by the controller 70. Alternatively, the controller 70 may be able to control the intensity of the light emitting diodes 21, 22 of the first set and the light emitting diodes 31, 32 of the second set individually (not shown). The cross-sectional view of FIG. 1B further shows the diffuser 68 and the further luminescent material 52 arranged on a wall of the light mixing chamber 60 substantially opposite the light exit window 62. Further alternatively the controller 70 may be arranged for changing a distance (not shown) of the light emitting diodes 21, 22 of the first set with respect to the first luminescent material 50 relative to the distance of the light emitting diodes 31, 32 of the second set.

Figure 2A:
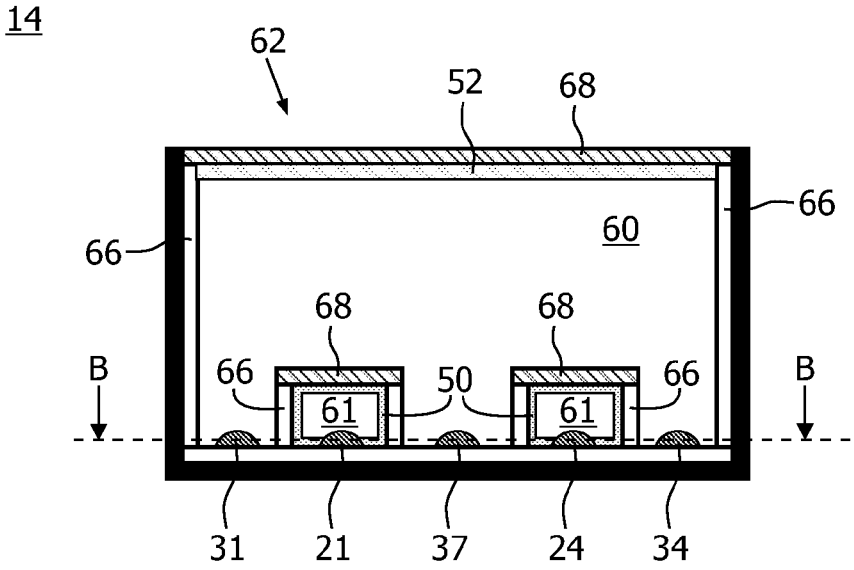
FIGS. 2A and 2B show schematic cross-sectional views of a further embodiment of the color-tunable illumination system according to the invention.
Figure 2B:
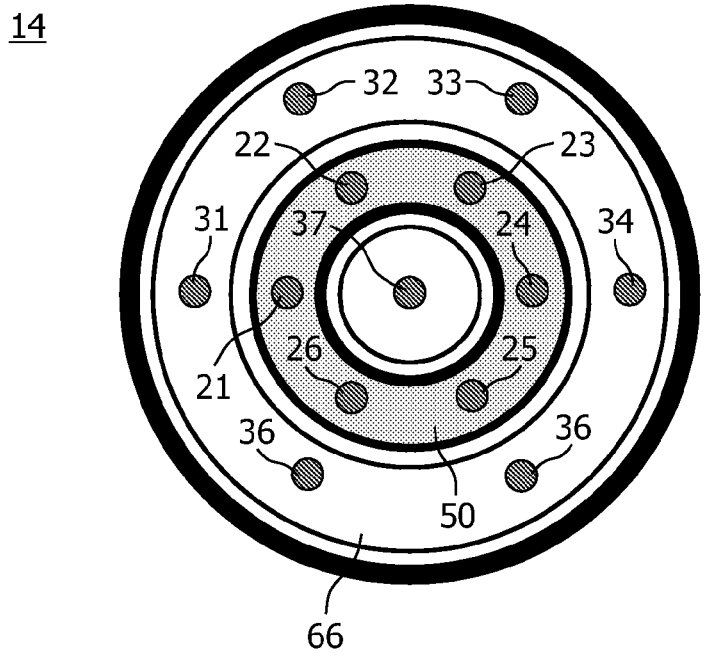

FIG. 1C shows a different embodiment of the color-tunable illumination system 12 according to the invention. In this embodiment, next to the first light source 21, the second light source 31, 32, the first luminescent material 50 and the further luminescent material 52, the color-tunable illumination system 12 further comprises a third light source 41 and a third luminescent material 54. In the current embodiment, the third light source 41 is constituted of a single light emitting diode 41. Of course, alternatively, the color-tunable illumination system 12 may comprise a third set of light emitting diodes (not shown) constituting the third light source 41. The arrangement of the third luminescent material 54 inside the light mixing chamber 60, again, is such that the first light source 21 and the second light source 31, 32 are shielded from directly illuminating the third luminescent material 54, while the third light source 41 is arranged for directly illuminating the third luminescent material 54. For example, the light of the first predefined color may be ultraviolet light which is converted by the further luminescent material in substantially white light, for example, using a mixture of the phosphors FIGS. 2A and 2B show schematic cross-sectional views of a further embodiment of the color-tunable illumination system 14 according to the invention. The light mixing chamber 60 again comprises the first luminescent material 50 arranged in the further light mixing chamber 61 in which the first set of light emitting diodes 21, 22, 23, 24, 25, 26 is arranged. The light mixing chamber 60 further comprises the second set of light emitting diodes 31, 32, 33, 34, 35, 36, 37 of the second light source 31, 32, 33, 34, 35, 36, 37. The light exit window 62 comprises the diffuser 68 and the further luminescent layer 52, for example, directly applied to the diffuser 68, or, alternatively, applied to or embedded in a different carrier material (not shown). Light of the first predefined color will impinge on the further luminescent layer 52 and will be converted into light of the further predefined color. Part of the light emitted by the further luminescent material 52 will be emitted directly away from the light exit window 62, while a further part of the light emitted by the further luminescent material 52 will be emitted into the light mixing chamber 60 and mix with the light of the first predefined color and with the light produced by the first luminescent material 50. The walls of the light mixing chamber 60 are again covered with a diffusely reflective layer 66, and the light exit window of the further light mixing chamber 61 also comprises a diffuser for enhancing the mixing of the light of the second predefined color with the light of the first predefined color. In addition, a diffuser applied to an exit window of the further light mixing chamber 61 (not shown) enables better shielding of the first luminescent material from light from the second light source. As indicated before, the light of the first predefined color may be ultraviolet light which is, for example, converted by the further luminescent layer 52 into substantially white light. Adding the light of the second predefined color changes the color temperature of the substantially white light. The light of the first predefined color may be the primary color blue in which part of the light of the primary color blue is, for example, converted by the further luminescent layer 52 into light of the primary color yellow which again combines with the primary color blue to substantially white light. Adding the light of the second predefined color changes the color temperature of the substantially white light. Using blue-emitting first and second light sources, a mixture of YAG:Ce (yellow) and CaS:Eu (red, 15% w/w) for the first luminescent material 50 and YAG:Ce for the further luminescent material 52 in a configuration as in FIG. 2A,B,C, a color temperature change from 5000 to 3000 K was achieved by controlling the relative intensities of the first and second light sources.

Alternatively, the colors of the first predetermined color, the second predetermined color and the third predetermined color may be any other color which is mixed in the light mixing chamber 60 to obtain a color-tunable light emission of the color-tunable illumination system 14 according to the invention. A benefit of the embodiment shown in FIGS. 2A and 2B is that the color-tunable illumination system 14 can be produced relatively compact. In addition, substantially all light of the second predefined color passes through the further luminescent layer 52 which further enhances the mixing of the light of the second predefined color with the light of the further predefined color. Preferable, the further luminescent material 52 should be chosen to not or only marginally absorb the light emitted by the first luminescent material 50. Alternatively, the light mixing chamber 60 of this further embodiment of the color-tunable illumination system 14 may comprise the third light source (not shown) and the third luminescent material (not shown). In such an embodiment, the further luminescent material 52 should preferably also be chosen to not or only marginally absorb the light emitted by the third luminescent material.

FIG. 2B shows a cross-sectional view of the color-tunable illumination system 14 along a cross-section BB indicated in FIG. 2A with a dashed line.

Figure 2C:
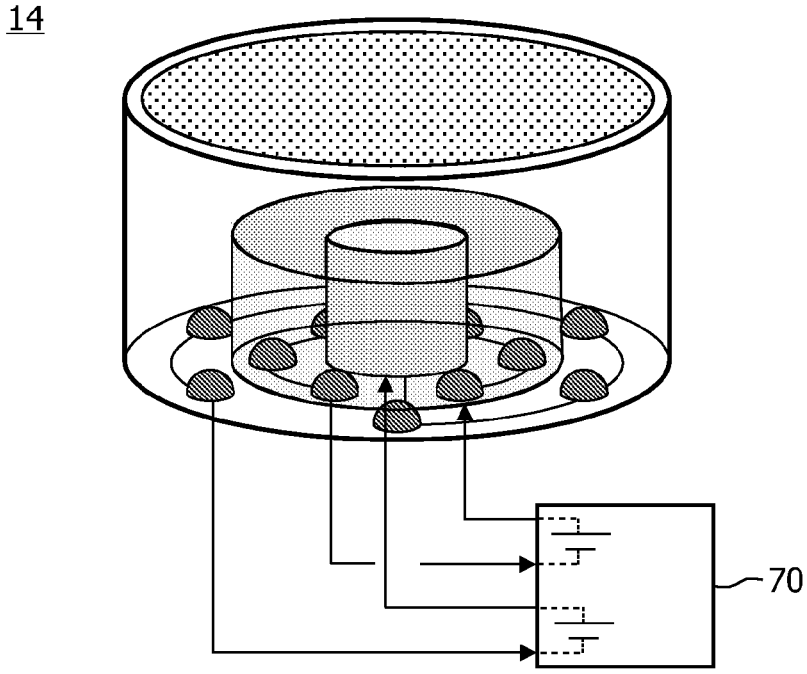
FIG. 2C shows a schematic three-dimensional view of the further embodiment of the color-tunable illumination system according to the invention.

FIG. 2C shows a schematic three-dimensional view of the further embodiment of the color-tunable illumination system 14 according to the invention. In this three-dimensional view of the further embodiment, the series arrangement of the first set of light emitting diodes 21, 22, 23, 24, 25, 26 and the series arrangement of the second set of light emitting diodes 31, 32, 33, 34, 35, 36, 37 is shown. The intensity of the light emitted by the light emitting diodes of the first set of light emitting diodes 21, 22, 23, 24, 25, 26 and/or the intensity of the light emitted by the light emitting diodes of the second set of light emitting diodes 31, 32, 33, 34, 35, 36, 37 is, for example, regulated by the controller 70, for example, by controlling a current through each of the series arrangement of light emitting diodes 21, 22, 23, 24, 25, 26; 31, 32, 33, 34, 35, 36, 37. Alternative any known arrangements for changing an intensity of light emitted by a light emitting diode may be applied by the person skilled in the art without departing from the scope of the invention.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A color-tunable illumination system, comprising:

a first light source, a second light source and a layer of first luminescent material being arranged inside a light mixing chamber having a light exit window for emitting the light therefrom, the first light source and the second light source each comprising at least one light emitting diode and emitting light of a first predefined color into the light mixing chamber, the first luminescent material absorbing light of the first predefined color and converting the absorbed light into light of a second predefined color different from the first predefined color, the first luminescent material being arranged remote from the first light source and the second light source, the first light source being positioned with respect to the first luminescent material for illuminating the first luminescent material with a first relative flux of light being a part of the light emitted by the first light source into the light mixing chamber, the second light source being positioned with respect to the first luminescent material for illuminating the first luminescent material with a second relative flux of light being a part of the light emitted by the second light source into the light mixing chamber, the first relative flux being different from the second relative flux, and a controller for controlling an intensity of the light emitted by the first light source relative to the intensity of the light emitted by the second light source for altering a flux of light of the first predefined color which illuminates the first luminescent material, or for controlling a position of the first light source with respect to the luminescent material relative to the position of the second light source with respect to the luminescent material.

2. Color-tunable illumination system as claimed in claim 1, wherein the first light source is arranged for directly illuminating the first luminescent material, and wherein the second light source is shielded from directly illuminating the first luminescent material.

3. Color-tunable illumination system as claimed in claim 2, wherein dichroic shielding means are arranged for shielding the second light source from illuminating the first luminescent material.

4. Color-tunable illumination system as claimed in claim 1, wherein the light mixing chamber comprises a further luminescent material converting light of the first predefined color into a further predefined color different from the first predefined color and the second predefined color.

5. Color-tunable illumination system as claimed in claim 1, wherein the first predefined color is within a range between 400 nanometers and 490 nanometers.

6. Color-tunable illumination system as claimed in claim 1 further comprising a third light source and a third luminescent material, the third light source comprising at least one light emitting diode emitting light of the first predefined color into the light mixing chamber, the third light source being arranged for directly illuminating the third luminescent material while the first light source and second light source being shielded from directly illuminating the third luminescent material, the third luminescent material absorbing light of the first predefined color and converting the absorbed light into light of a third predefined color different from the first predefined color and second predefined color.

7. Color-tunable illumination system as claimed in claim 1, wherein the first luminescent material and/or the further luminescent material and/or the third luminescent material comprises a phosphor composition being a mixture of phosphors, each phosphor composition of the first luminescent material, the further luminescent material and/or the third luminescent material being different.

8. Color-tunable illumination system as claimed in claim 1, wherein the first light source and/or the second light source comprises a series arrangement of a plurality of light emitting diodes.

9. Color-tunable illumination system as claimed in claim 7, wherein each light emitting diode of the first light source is arranged for directly illuminating the first luminescent material, and wherein each light emitting diode of the second light source is shielded from directly illuminating the first luminescent material.

10. Color-tunable illumination system as claimed in claim 8, wherein the light emitting diodes of the first light source are arranged in a further light mixing chamber comprising the first luminescent material or in a plurality of further light mixing chambers comprising the first luminescent material, the further light mixing chamber or the plurality of further light mixing chambers being arranged inside the light mixing chamber.

11. Color-tunable illumination system as claimed in claim 10 when comprising the further luminescent material, wherein the plurality of light emitting diodes are arranged to substantially uniformly illuminate the light exit window of the light mixing chamber and wherein the further luminescent material is arranged at the light exit window of the light mixing chamber.

12. Color-tunable illumination system as claimed in claim 1, wherein the first light source and the second light source are arranged on an edge (65) of the light mixing chamber next to the light exit window, each of the first light source and the second light source emitting light away from the light exit window preventing direct illumination of the light exit window by the first light source and the second light sources.

13. Color-tunable illumination system as claimed in claim 4, wherein the first predefined color is the color blue, the first luminescent material converts the absorbed light of the first predefined color into amber light being the second predefined color, and the further luminescent material converts the absorbed light of the first predefined color into yellow light being the further predefined color.

14. Luminaire comprising the color-tunable illumination system as claimed in claim 1.

* * * * *